US009668080B2

(12) United States Patent
Sun et al.

(10) Patent No.: US 9,668,080 B2
(45) Date of Patent: May 30, 2017

(54) METHOD FOR GENERATING A SURROUND SOUND FIELD, APPARATUS AND COMPUTER PROGRAM PRODUCT THEREOF

(71) Applicant: Dolby Laboratories Licensing Corporation, San Francisco, CA (US)

(72) Inventors: Xuejing Sun, Beijing (CN); Bin Cheng, Beijing (CN); Sen Xu, Beijing (CN); Zhiwei Shuang, Beijing (CN); Jun Wang, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 14/899,505

(22) PCT Filed: Jun. 17, 2014

(86) PCT No.: PCT/US2014/042800
§ 371 (c)(1),
(2) Date: Dec. 17, 2015

(87) PCT Pub. No.: WO2014/204999
PCT Pub. Date: Dec. 24, 2014

(65) Prior Publication Data

US 2016/0142851 A1 May 19, 2016

Related U.S. Application Data

(60) Provisional application No. 61/839,474, filed on Jun. 26, 2013.

(30) Foreign Application Priority Data

Jun. 18, 2013 (CN) ..... 2013 1 0246729

(51) Int. Cl.
*H04R 5/02* (2006.01)
*H04S 7/00* (2006.01)
(Continued)

(52) U.S. Cl.
CPC ..... *H04S 7/301* (2013.01); *H04R 29/002* (2013.01); *H04R 29/005* (2013.01); *H04S 3/02* (2013.01);
(Continued)

(58) Field of Classification Search
CPC ..... H04S 3/00; H04S 3/02; H04S 7/00; H04S 7/301; H04S 7/302; H04S 2400/15;
(Continued)

(56) References Cited

U.S. PATENT DOCUMENTS 5,757,927 A * 5/1998 Gerzon ..... H04S 3/02 381/18
7,277,692 B1 10/2007 Jones
(Continued)

FOREIGN PATENT DOCUMENTS

CN 1256851 6/2000
CN 1898988 1/2007
(Continued)

OTHER PUBLICATIONS

Raykar, V.C. et al "Position Calibration of Microphones and Loudspeakers in Distributed Computing Platforms" IEEE Transactions on Speech and Audio Processing, vol. 13, Issue 1, pp. 70-83, Jan. 2005.

(Continued)

*Primary Examiner* — Xu Mei

(57) ABSTRACT

Embodiments of the present invention relate to adaptive audio content generation. Specifically, a method for generating adaptive audio content is provided. The method comprises extracting at least one audio object from channel-
(Continued)

based source audio content, and generating the adaptive audio content at least partially based on the at least one audio object. Corresponding system and computer program product are also disclosed.

13 Claims, 12 Drawing Sheets

(51) Int. Cl.
*H04R 29/00* (2006.01)
*H04S 3/02* (2006.01)

(52) U.S. Cl.
CPC ..... *H04R 2430/20* (2013.01); *H04S 7/308* (2013.01); *H04S 2400/03* (2013.01); *H04S 2400/15* (2013.01); *H04S 2420/01* (2013.01); *H04S 2420/11* (2013.01)

(58) Field of Classification Search
CPC ..... H04S 2420/00; H04S 2420/03; H04S 2420/11; H04R 29/00; H04R 29/001; H04R 29/002; H04R 29/004; H04R 29/005; H04R 2430/00; H04R 2430/20; H04R 2430/21; H04R 2430/23; H04R 2430/25
USPC ..... 381/1, 17–23, 307, 309, 310, 26, 91, 92, 381/122
See application file for complete search history.

(56) References Cited

U.S. PATENT DOCUMENTS

| | | | | |
|---|---|---|---|---|
| 7,636,448 | B2 * | 12/2009 | Metcalf | H04S 3/002 381/118 |
| 7,711,443 | B1 | 5/2010 | Sanders | |
| 7,729,204 | B2 | 6/2010 | Peng | |
| 7,864,631 | B2 * | 1/2011 | Van Leest | H04S 7/301 367/124 |
| 8,103,006 | B2 * | 1/2012 | McGrath | H04S 3/02 381/1 |
| 8,160,270 | B2 * | 4/2012 | Oh | H04R 1/406 381/92 |
| 8,264,934 | B2 | 9/2012 | Waites | |
| 8,279,709 | B2 * | 10/2012 | Choisel | H04R 5/02 367/127 |
| 9,313,336 | B2 * | 4/2016 | Ganong, III | H04M 3/569 |
| 2004/0106398 | A1 | 6/2004 | Statham | |
| 2005/0190928 | A1 | 9/2005 | Noto | |
| 2006/0147028 | A1 | 7/2006 | Hancock | |
| 2007/0147634 | A1 | 6/2007 | Chu | |
| 2008/0077261 | A1 | 3/2008 | Baudino | |
| 2009/0017868 | A1 | 1/2009 | Ueda | |
| 2009/0051624 | A1 | 2/2009 | Finney | |
| 2009/0264114 | A1 | 10/2009 | Virolainen | |
| 2009/0304214 | A1 | 12/2009 | Xiang | |
| 2010/0218097 | A1 | 8/2010 | Herberger | |
| 2010/0322431 | A1 | 12/2010 | Lokki | |
| 2011/0161074 | A1 | 6/2011 | Pance | |
| 2012/0114126 | A1 | 5/2012 | Thiergart | |
| 2012/0128160 | A1 | 5/2012 | Kim | |
| 2012/0155653 | A1 * | 6/2012 | Jax | G10L 19/008 381/22 |
| 2013/0016842 | A1 * | 1/2013 | Schultz-Amling | G10L 19/173 381/17 |

FOREIGN PATENT DOCUMENTS

| | | |
|---|---|---|
| CN | 1969589 | 5/2007 |
| JP | 2004-159310 | 6/2004 |
| JP | 2005-217559 | 8/2005 |
| JP | 2007-522711 | 8/2007 |
| JP | 2010-534424 | 11/2010 |
| WO | 2012/007152 | 1/2012 |
| WO | 2012/072798 | 6/2012 |

OTHER PUBLICATIONS

Casas, R. et al "Synchronization in Wireless Sensor Networks Using Bluetooth", Third International Workshop on Intelligent Solutions in Embedded Systems, pp. 79-88, May 20, 2005.

* cited by examiner

METHOD FOR GENERATING A SURROUND SOUND FIELD, APPARATUS AND COMPUTER PROGRAM PRODUCT THEREOF

CROSS-REFERENCE TO RELATED APPLICATIONS

This application claims the benefit of priority to Chinese Patent Application No. 201310246729.2 filed on 18 Jun. 2013 and U.S. Provisional Patent Application No. 61/839,474 filed on 26 Jun. 2013, both hereby incorporated by reference in its entirety

TECHNOLOGY

The present application relates to signal processing. More specifically, embodiments of the present invention relate to generating surround sound field.

BACKGROUND

Traditionally the surround sound field is created either by means of dedicated surround sound recording equipments, or by professional sound mixing engineers or software applications that pan sound sources to different channels. Neither of these two approaches is easily accessible to end users. In the past decades, the increasingly ubiquitous mobile devices, such as mobile phones, tablets, media players, and game consoles, have been equipped with audio capturing and/or processing functionalities. However, most mobile devices (mobile phones, tablets, media players, game consoles) are only used to achieve mono audio capture.

There have been proposed several approaches for surround sound field creation using mobile devices. However, those approaches either strictly rely on access points or fail to take into consideration the nature of commonly-used, non-professional mobile devices. For example, in creating a surround sound field using an ad hoc network of heterogeneous user devices, the recording time of different mobile devices might not be synchronized, and the locations and topology of the mobile devices might be unknown. Moreover, the gains and frequency responses of audio capturing devices may be different. As a result, at present, it is incapable of generating a surround sound field effectively and efficiently by use of audio capturing devices of everyday users.

In view of the foregoing, there is a need in the art for a solution capable of generating the surround sound field in an effective and efficient manner.

SUMMARY

In order to address the foregoing and other potential problems, embodiments of the present invention propose a method, apparatus, and computer program product for generating the surround sound field.

In one aspect, embodiments of the present invention provide a method of generating a surround sound field. The method comprises: receiving audio signals captured by a plurality of audio capturing devices; estimating a topology of the plurality of audio capturing devices; and generating the surround sound field from the received audio signals at least partially based on the estimated topology. Embodiments in this aspect also include corresponding computer program product comprising a computer program tangibly embodied on a machine readable medium for carrying out the method.

In another aspect, embodiments of the present invention provide an apparatus of generating a surround sound field. The apparatus comprises: a receiving unit configured to receive audio signals captured by a plurality of audio capturing devices; a topology estimating unit configured to estimate a topology of the plurality of audio capturing devices; and a generating unit configured to generate the surround sound field from the received audio signals at least partially based on the estimated topology.

These embodiments of the present invention can be implemented to realize one or more of the following advantages. In accordance with embodiments of the present invention, the surround sound field may be generated by use of an ad hoc network of audio capturing devices of end users, such as microphones equipped on mobile phones. As such, the need for expensive and complex professional equipments and/or human experts can be eliminated. Furthermore, by generating the surround sound field dynamically based on the estimation of topology of the audio capturing devices, the quality of the surround sound field can be maintained at a higher level.

Other features and advantages of embodiments of the present invention will also be understood from the following description of example embodiments when read in conjunction with the accompanying drawings, which illustrate, by way of example, spirit and principles of the present invention.

DESCRIPTION OF DRAWINGS

The details of one or more embodiments of the present invention are set forth in the accompanying drawings and the description below. Other features, aspects, and advantages of the invention will become apparent from the description, the drawings, and the claims, wherein:

Throughout the figures, same or similar reference numbers indicates same or similar elements.

DESCRIPTION OF EXAMPLE EMBODIMENTS

In general, embodiments of the present invention provide a method, apparatus, and computer program product for surround sound field generation. In accordance with embodiments of the present invention, the surround sound field may be effectively and accurately generated by use of an ad hoc network of audio capturing devices such as mobile phones of end users. Some embodiments of the present invention will be detailed below.

Figure 1:
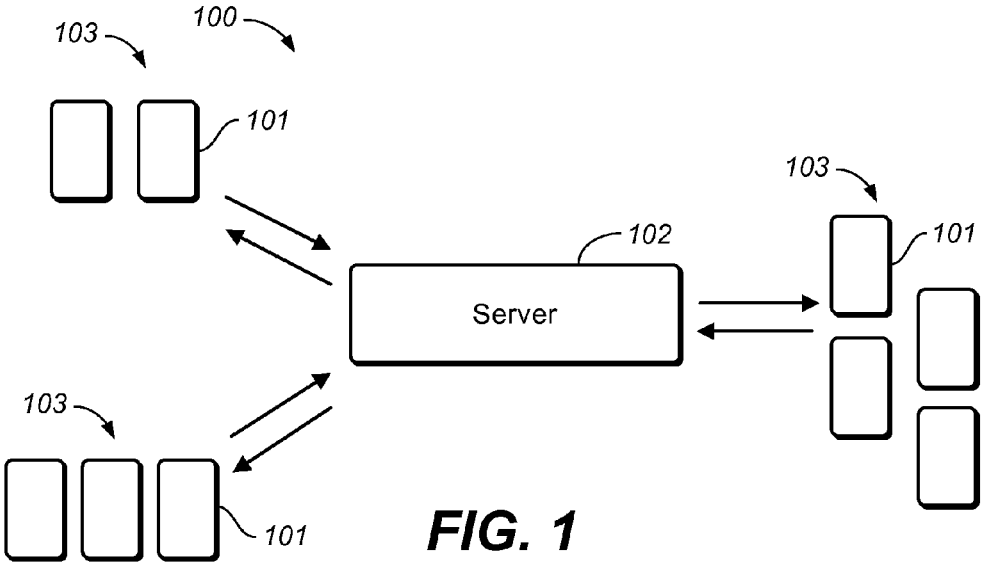
FIG. 1 shows a block diagram illustrating a system in which example embodiments of the present invention can be implemented.

Reference is first made to FIG. 1, where a block diagram illustrating a system 100 in which embodiments of the present invention can be implemented is shown. In FIG. 1, the system 100 includes a plurality of audio capturing devices 101 and a server 102. In accordance with embodiments of the present invention, the audio capturing devices 101, among other things, are capable of capturing, recording and/or processing audio signals. Examples of the audio capturing devices 101 may include, but not limited to, mobile phones, personal digital assistants (PDAs), laptops, tablet computers, personal computers (PCs) or any other suitable user terminals equipped with audio capturing functionality. For example, those commercially available mobile phones are usually equipped with at least one microphone and therefore can be used as the audio capturing devices 101.

In accordance with embodiments of the present invention, the audio capturing devices 101 may be arranged in one or more ad hoc networks or groups 103, each of which may include one or more audio capturing devices. The audio capturing devices may be grouped according to a predetermined strategy or dynamically, which will be detailed below. Different groups can be located at same or different physical locations. Within each group, the audio capturing devices are located in the same physical location, and may be positioned proximate to each other.

Figure 2A:
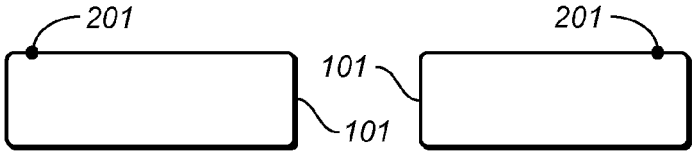
FIGS. 2A-2C show schematic diagrams illustrating several examples of topologies of audio capturing devices in accordance with example embodiments of the present invention.
Figure 2A:
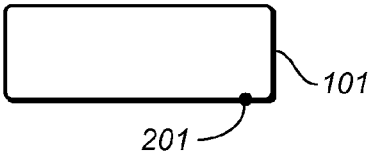
Figure 2B:
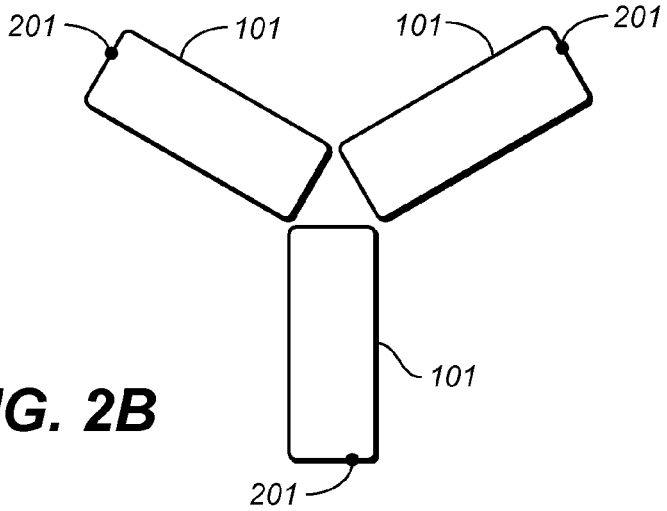
Figure 2C:
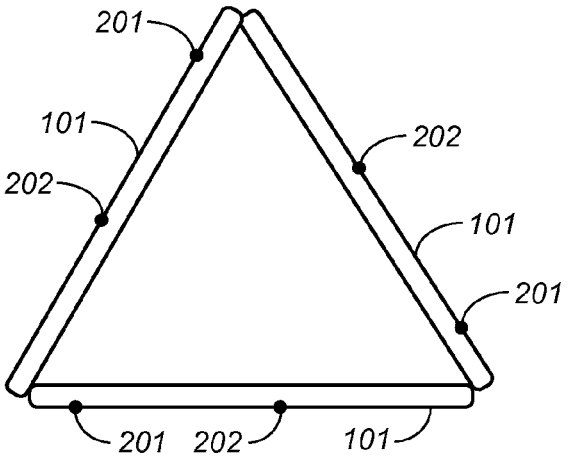

FIGS. 2A-2C show some examples of groups consisting of three audio capturing devices. In the example embodiments shown in FIGS. 2A-2C, the audio capturing devices 101 may be mobile phones, PDAs or any other portable user terminals that are equipped with audio capturing elements 201, such as one or more microphones, to capture audio signals. Specifically, in the example embodiment shown in FIG. 2C, the audio capturing devices 101 are further equipped with video capturing elements 202 such as cameras, so that the audio capturing devices 101 may be configured to capture video and/or image while capturing audio signals.

It should be noted that the number of audio capturing devices within a group is not limited to three. Instead, any suitable number of audio capturing devices may be arranged as a group. Moreover, within a group, the plurality of audio capturing devices may be arranged as any desired topology. In some embodiments, the audio capturing devices within a group may communicate with each other by means of computer network, Bluetooth, infrared, telecommunication, and the like, just to name a few.

Continuing reference to FIG. 1, as shown, the server 102 is communicatively connected with the groups of audio capturing devices 101 via network connections. The audio capturing devices 101 and the server 102 may communicate with each other, for example, by a computer network such as a local area network ("LAN"), a wide area network ("WAN") or the Internet, a communication network, a near field communication connection, or any combination thereof. The scope of the present invention is not limited in this regard.

In operation, the generation of surround sound field may be initiated either by an audio capturing device 101 or by the server 102. Specifically, in some embodiments, an audio capturing device 101 may log into the server 102 and request the server 102 to generate a surround sound field. Then the audio capturing device 101 sending the request will become a master device which then sends invitations to other capturing devices to join the audio capturing session. In this regard, there may be a predefined group to which the master device belongs. In these embodiments, the other audio capturing devices within this group receive the invitation from the master device and join the audio capturing session accordingly. Alternatively or additionally, another one or more audio capturing devices may be dynamically identified and grouped with the master device. For example, in case that location services like GPS (Global Positioning Service) are available to the audio capturing devices 101, it is possible to automatically invite one or more audio capturing devices located in proximity to the master device to join the audio capturing group. Discovery and grouping of the audio capturing devices may also be performed by the server 102 in some alternative embodiments.

Upon forming a group of audio capturing devices, the server 102 sends a capturing command to all the audio capturing devices within the group. Alternatively, the capturing command may be sent by one of the audio capturing devices 101 within the group, for example, by the master device. Each audio capturing device in the group will start to capture and record audio signals immediately after receiving the capturing command. The audio capturing session will finish when any audio capturing device stops the capturing. During audio capture, the audio signals may be recorded locally on the audio capturing devices 101 and transmitted to the server 102 after the capturing session is completed. Alternatively, the captured audio signals may be streamed to the server 102 in a real-time manner.

In accordance with embodiments of the present invention, the audio signals captured by the audio capturing devices 101 of a single group are assigned with the same group identification (ID), such that the server 102 is able to identify whether the incoming audio signals belong to the same group. Further, in addition to the audio signals, any information relevant to the audio capturing session may be transmitted to the server 102, including the number of audio capturing devices 101 within the group, parameters of one or more audio capturing devices 101, and the like.

Based on the audio signals captured by a plurality of capturing devices 101 of a group, the server 102 performs a series of operations to process the audio signals to generate a surround sound field. In this regard, FIG. 3 shows a flowchart of a method for generating the surround sound field from the audio signals captured by the plurality of capturing devices 101.

Figure 3:
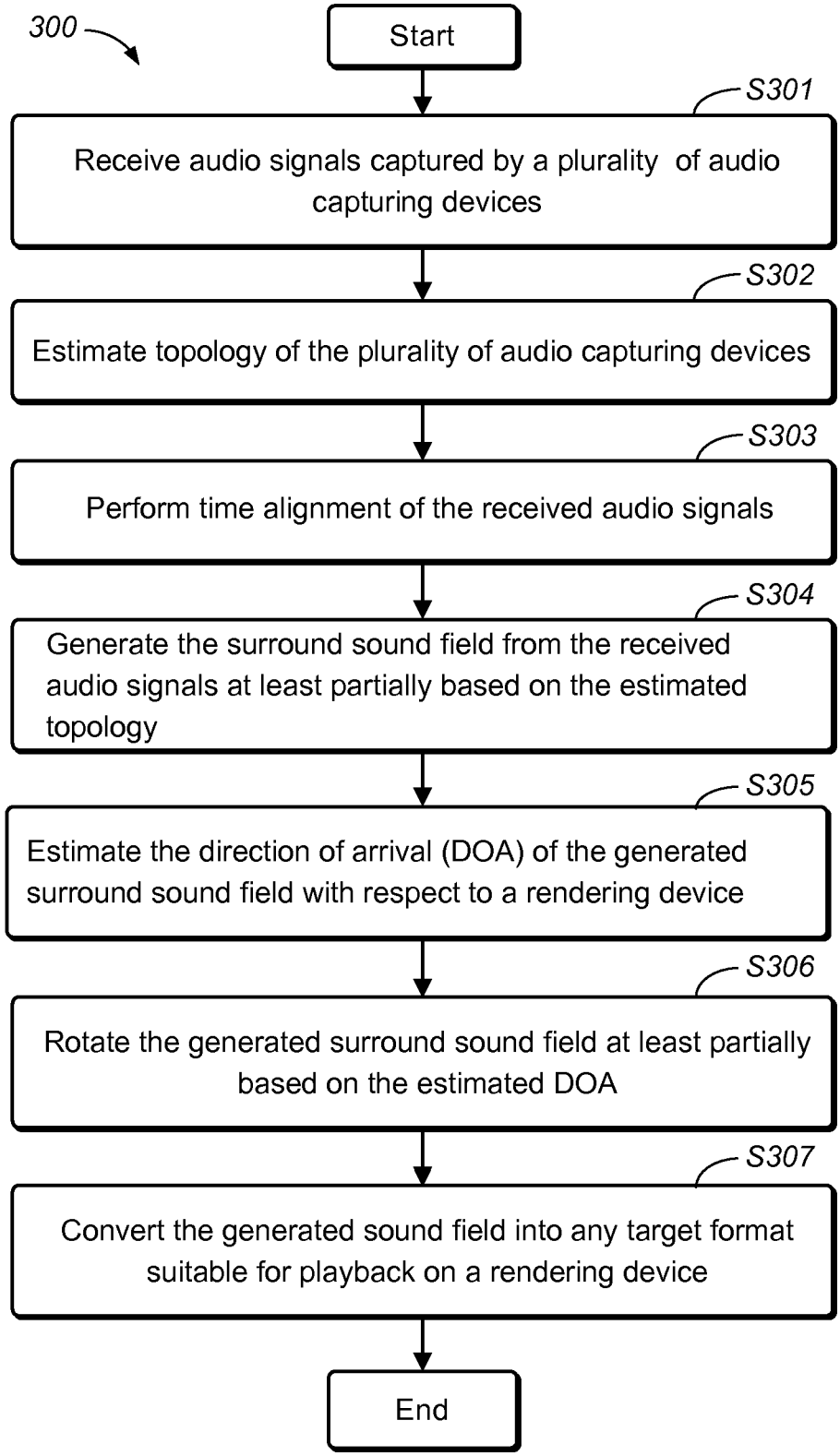
FIG. 3 shows a flowchart illustrating a method for generating a surround sound field in accordance with an example embodiment of the present invention.

As shown in FIG. 3, upon receipt of the audio signals captured by a group of audio capturing devices 101 at step 5301, the topology of these audio capturing devices are estimated at step 5302. Estimating the topology of positions of audio capturing devices 101 within the group is important to the subsequent spatial processing, which has direct impact on reproducing the sound field. In accordance with embodiments of the present invention, the topology of audio capturing devices may be estimated in various manners. For example, in some embodiments, the topology of audio capturing devices 101 may be predefined and thus known to the server 102. In this event, the server 102 may use the group ID to determine the group from which the audio signals are transmitted, and then retrieve the predefined topology associated with the determined group as the topology estimation.

Alternatively or additionally, the topology of audio capturing devices 101 may be estimated based on the distance between each pair of the plurality of audio capturing devices 101 within the group. There are many possible manners capable of acquiring the distance between a pair of audio capturing devices 101. For example, in those embodiments where the audio capturing devices are capable of playing back audios, each audio capturing device 101 may be configured to each play back a piece of audio simultaneously and to receive audio signals from the other devices within the group. That is, each audio capturing device 101 broadcasts a unique audio signal to the other members of the group. As an example, each audio capturing device may play back a linear chirp signal spanning a unique frequency range and/or having any other specific acoustic features. By recording the time instants when the linear chirp signal is received, the distance between each pair of audio capturing devices 101 may be calculated by an acoustic ranging processing, which is known to those skilled in the art and thus will not be detailed here.

Such distance calculation may be performed at the server 102, for example. Alternatively, if the audio capturing devices may communicate with each other directly, such distance calculation may be performed at the client side. At the server 102, no additional processing is needed if there are only two audio capturing devices 101 in the group. When there are more than two audio capturing devices 101, in some embodiments, the multidimensional scaling (MDS) analysis or a similar process can be performed on the acquired distances to estimate the topology of the audio capturing devices. Specifically, with an input matrix indicating the distances of pairs of audio capturing devices 101, MDS may be applied to generate the coordinates of the audio capturing devices 101 in a two-dimensional space. For example, assume that the measured distance matrix in a three-device group is $$\begin{pmatrix} 0 & 0.1 & 0.1 \\ 0.1 & 0 & 0.15 \\ 0.1 & 0.15 & 0 \end{pmatrix}.$$

Then outputs of the two-dimensional (2D) MDS indicating the topology of audio capturing device 101 are M1(0, −0.0441), M2 (−0.0750, 0.0220), and M3 (0.0750, 0.0220).

It should be noted that the scope of the present invention is not limited to the examples illustrated above. Any suitable manner capable of estimating distance between a pair of audio capturing devices, whether currently known or developed in the future, may be used in connection with embodiments of the present invention. For example, instead of playing back audio signals, the audio capturing devices 101 may be configured to broadcast electrical and/or optical signals to each other to facilitate the distance estimation.

Next, the method 300 proceeds to step S303, where the time alignment is performed on the audio signals received at step S301, such that the audio signals captured by different capturing devices 101 are temporally aligned with each other. In accordance with embodiments of the present invention, time alignment of the audio signals may be done in many possible manners. In some embodiments, the server 102 may implement a protocol based clock synchronization process. For example, the Network Time Protocol (NTP) provides accurate and synchronized time across the Internet. When connecting to the internet, each audio capturing device 101 may be configured to synchronize with an NTP server separately while performing audio capturing. It is not necessary to adjust the local clock. Instead, an offset between the local clock and the NTP server can be calculated and stored as metadata. The local time and its offset are sent to the server 102 together with the audio signals once the audio capturing is terminated. The server 102 then aligns the received audio signals based on such time information.

Alternatively or additionally, the time alignment at step 5303 may be realized by a peer-to-peer clock synchronization process. In these embodiments, the audio capturing devices may be communicated with each other on a peer-to-peer basis, for example, via protocols like Bluetooth or infrared connection. One of the audio capturing devices may be selected as the synchronization master and clock offsets of all the other capturing devices may be calculated relative to the synchronization master.

Another possible implementation is cross-correlation based time alignment. As known, a series of cross-correlation coefficients between a pair of input signals, x(i) and y(i), may be calculated by:

$$r(d) = \frac{\sum_{i=0}^{N-1} [(x(i) - \bar{x}) \cdot (y(i-d) - \bar{y})]}{\sqrt{(x(i) - \bar{x})^2} \sqrt{(y(i-d) - \bar{y})^2}}$$

where $\bar{x}$ and $\bar{y}$ represent the mean of x(i) and y(i), N represents the length of x(i) and y(i), and d represents the time lag between the two series. The delay between the two signals may be calculated as follows:

$$D = \arg\max_{d}\{r(d)\}$$

Then using x(i) as the reference, signal y(i) can be time-aligned to x(i) by:

$$y(k)=y(i-D)$$

It would be appreciated that though the time alignment can be realized by applying the cross-correlation process, this process can be time consuming and error prone if the search range is large. However, in practice the search range has to be fairly long in order to accommodate large network delay variations. To address this problem, information on calibration signals issued by the audio capturing devices 101 may be collected and transmitted to the server 102 to be used to reduce the search range of the cross-correlation process. As described above, in some embodiments of the present invention, the audio capturing devices 101 may broadcast an audio signal to the other members within the group upon start of the audio capture to thereby facilitate calculation of the distance between each pair of the audio capturing devices 101. In these embodiments, the broadcasted audio signals can also be used as calibration signals to reduce the time consumed by signal correlation. Specifically, considering two audio capturing devices A and B within a group, it is assumed that:

$S_A$ is the time instant when device A issues a command to play the calibration signal;

$S_B$ is the time instant when device B issues a command to play the calibration signal;

$R_{AA}$ is the time instant when device A receives the signal transmitted by device A;

$R_{BA}$ is the time instant when device A receives the signal transmitted by device B;

$R_{BB}$ is the time instant when device B receives the signal transmitted by device B; $R_{AB}$ is the time instant when device B receives the signal transmitted by device A.

One or more of these time instants may be recorded by the audio capturing devices 101 and transmitted to the server 102 for use in cross-correlation process.

Generally speaking, the acoustic propagation delay from device A to device B is smaller than the network delay difference. That is, $S_B-S_A>R_{AB}-S_A$. Accordingly, the time instants $R_{BA}$ and $R_{BB}$ can be used to start the cross-correlation based time alignment process. In other words, only audio signal samples after the time instant $R_{BA}$ and $R_{BB}$ would be included in the correlation calculation. In this way, the search range may be reduced and thus improve efficiency of the time alignment.

It is possible, however, that the network delay difference is smaller than acoustic propagation delay difference. This could happen when the network has very low jitter or the two devices are put farther apart, or both. In this case, $S_B$ and $S_A$ can be used as the starting point for the cross correlation process. Specifically, since audio signals after $S_B$ and $S_A$ would contain the calibration signals, $R_{BA}$ can be used as the starting point for correlation for device A, and $S_B+(R_{BA}-S_A)$ can be used as the starting point for correlation for device B.

It would be appreciated that the above mechanisms for time alignment may be combined in any suitable manner. For example, in some embodiments of the present invention, the time alignment can be done in a three-step process. First, the coarse time synchronization may be performed between the audio capturing devices 101 and the server 102. Next, the calibration signals as discussed above may be used to refine the synchronization. Finally, cross-correlation analysis is applied to complete the time alignment of the audio signals.

It should be noted that the time alignment at step S303 is optional. For example, if the communication and/or device conditions are good enough, it is reasonably considered that all the audio capturing devices 101 receive the capturing command nearly at the same time and thus start the audio capturing simultaneously. Furthermore, it would be readily appreciated that in some applications where the quality of surround sound field is not very sensitive, a certain degree of misalignment of the starting time of audio capturing can be tolerated or ignored. In these situations, the time alignment at step S303 can be omitted.

Specifically, it should be noted that step S302 is not necessarily performed prior to S303. Instead, in some alternative embodiments, the time alignment of audio signals may be performed prior to or even in parallel with the topology estimation. For example, the clock synchronization process such as NTP synchronization or peer-to-peer synchronization can be performed before the topology estimation. Depending on the acoustic ranging approach, such clock synchronization process may be beneficial to acoustic ranging in topology estimation.

Continuing reference to FIG. 3, at step S304, the surround sound field is generated from the received audio signals (possibly temporally aligned) at least partially based on the topology estimated at step S302. To this end, in accordance with some embodiments, a mode may be selected for processing the audio signals based on the number of the plurality of audio capturing devices. For example, if there are only two audio capturing devices 101 within the group, the two audio signals may be simply combined to generate a stereo output. Optionally, some post processing may be performed, including but not limited to stereo sound image widening, multi-channel upmixing, and so forth. On the other hand, when there are more than two audio capturing devices 101 within the group, Ambisonics or B-format processing may be applied to generate the surround sound field. It should be noted that the adaptive selection of processing mode is not necessarily needed. For example, even if there are only two audio capturing devices, the surround sound field may be generated by processing the captured audio signals by the B-format processing.

Next, some embodiments of the present invention of how to generate the surround sound field will be discussed with reference to the Ambisonics processing. However, it should be noted that the scope of the present invention is not limited in this regard. Any suitable techniques capable of generating the surround sound field from the received audio signals based on the estimated topology may be used in connection with embodiments of the present invention. For example, the binaural or 5.1-channel surround sound generation technology may be utilized as well.

As to Ambisonics, it is known as a flexible spatial audio processing technique to provide sound field and source localization recoverability. In Ambisonics, a 3D surround sound field is recorded as a four-channel signal, named B-format with W-X-Y-Z channels. The W channel contains omnidirectional sound pressure information, while the remaining three channels, X, Y, and Z represent sound velocity information measured over the three according axes in a 3D Cartesian coordinates. Specifically, given a sound source S localized at azimuth $\phi$ and elevation $\theta$, an ideal B-format representation of the surround sound field is:

$$W = \frac{\sqrt{2}}{2}S$$

$$X = \cos\varphi \cdot \cos\theta \cdot S$$

$$Y = \sin\varphi \cdot \cos\theta \cdot S$$

$$Z = \sin\theta \cdot S$$

For sake of simplicity, in the following discussion of the generation of directivity patterns for B-format signals, only the horizontal W, X, and Y channels are considered while the elevation axis Z will be ignored. This is a reasonable assumption because with the way the audio signals are captured by the audio capturing devices 101 in accordance with embodiments of the present invention, there is generally no elevation information.

Given a plane wave, the directivity of a discrete array can be represented as follows:

$$D(f, \alpha) = \sum_{n=-\frac{N-1}{2}}^{\frac{N-1}{2}} A_n(f, r)e^{j2\pi\alpha \cdot r}$$

where $$r = \begin{bmatrix} x_a \\ y_a \end{bmatrix} = \begin{bmatrix} R\cos\varphi_M \\ R\sin\varphi_M \end{bmatrix}$$

represents the spatial location of an audio capturing device with distance to the center of R and angle of $\phi_M$, and $\alpha$ represents the source location at angle $\phi$:

$$\alpha=[\cos\phi\ \sin\phi\ 0]$$

Further, $A_n(f,r)$ represents the weight for the audio capturing devices, which can be defined as the product of user defined weights and the gain of audio capturing device at a particular frequency and angle:

$$A_n(f,r)=W_n(f)r(\phi)$$

$$r(\phi)=\beta+(1-\beta)\cos(\phi)$$

where $\beta=0.5$ represents a cardioid polar pattern, $\beta=0.7$ represents a subcardioid polar pattern, and $\beta=1$ represents omni directivity.

It can be seen that once the polar pattern and the position topology of the audio capturing devices are determined, the weights $W_n(f)$ for respective captured audio signals will affect the quality of the generated surround sound field. Different weights $W_n(f)$ would generate different qualities of B-format signals. Weights for different audio signals may be represented as a mapping matrix. Considering the topology shown in FIG. 2A as an example, the mapping matrix (W) from audio signals $M_1$, $M_2$, and $M_3$ to W, X, and Y channels may be defined as follows:

$$W=\begin{bmatrix}\frac{1}{3} & \frac{1}{3} & \frac{1}{3}\\ \frac{1}{2} & \frac{1}{2} & -1\\ 1 & -1 & 0\end{bmatrix}$$

$$\begin{bmatrix}W\\ X\\ Y\end{bmatrix}=W\times\begin{bmatrix}M_1\\ M_2\\ M_3\end{bmatrix}$$

Figure 4A:
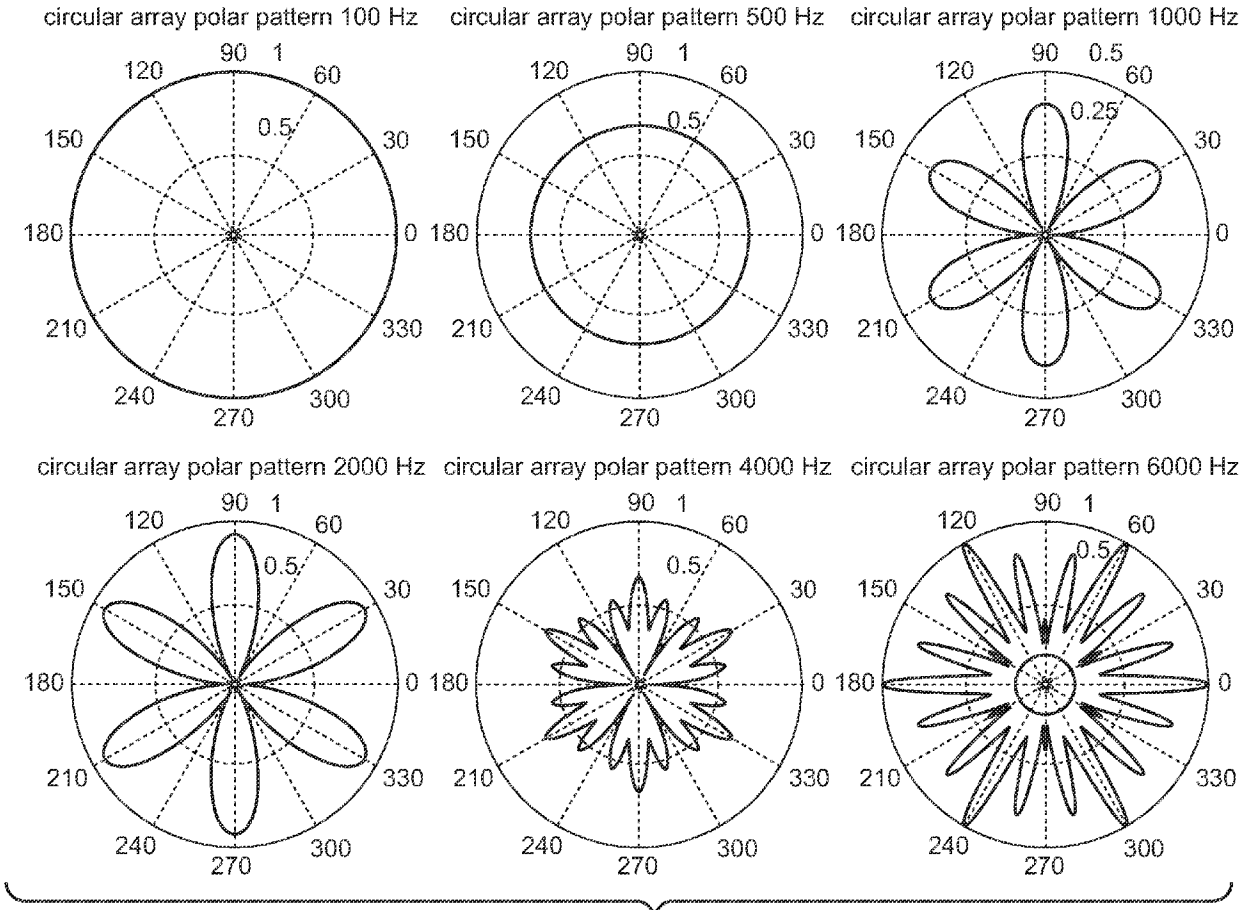
FIGS. 4A-4C show schematic diagrams illustrating polar patterns for W, X, and Y channels, respectively, in B-format processing for various frequencies when using an example mapping matrix.
Figure 4B:
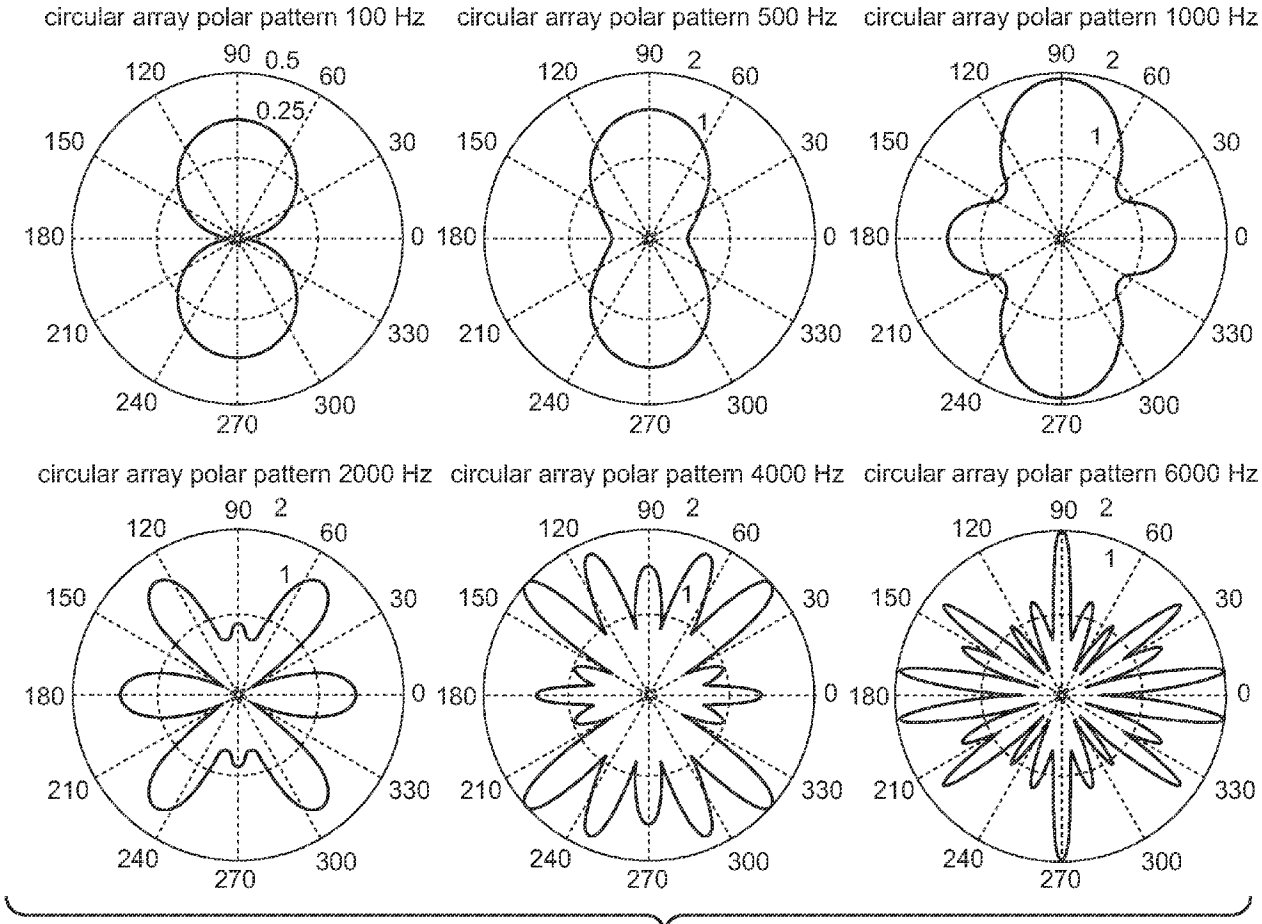
Figure 4C:
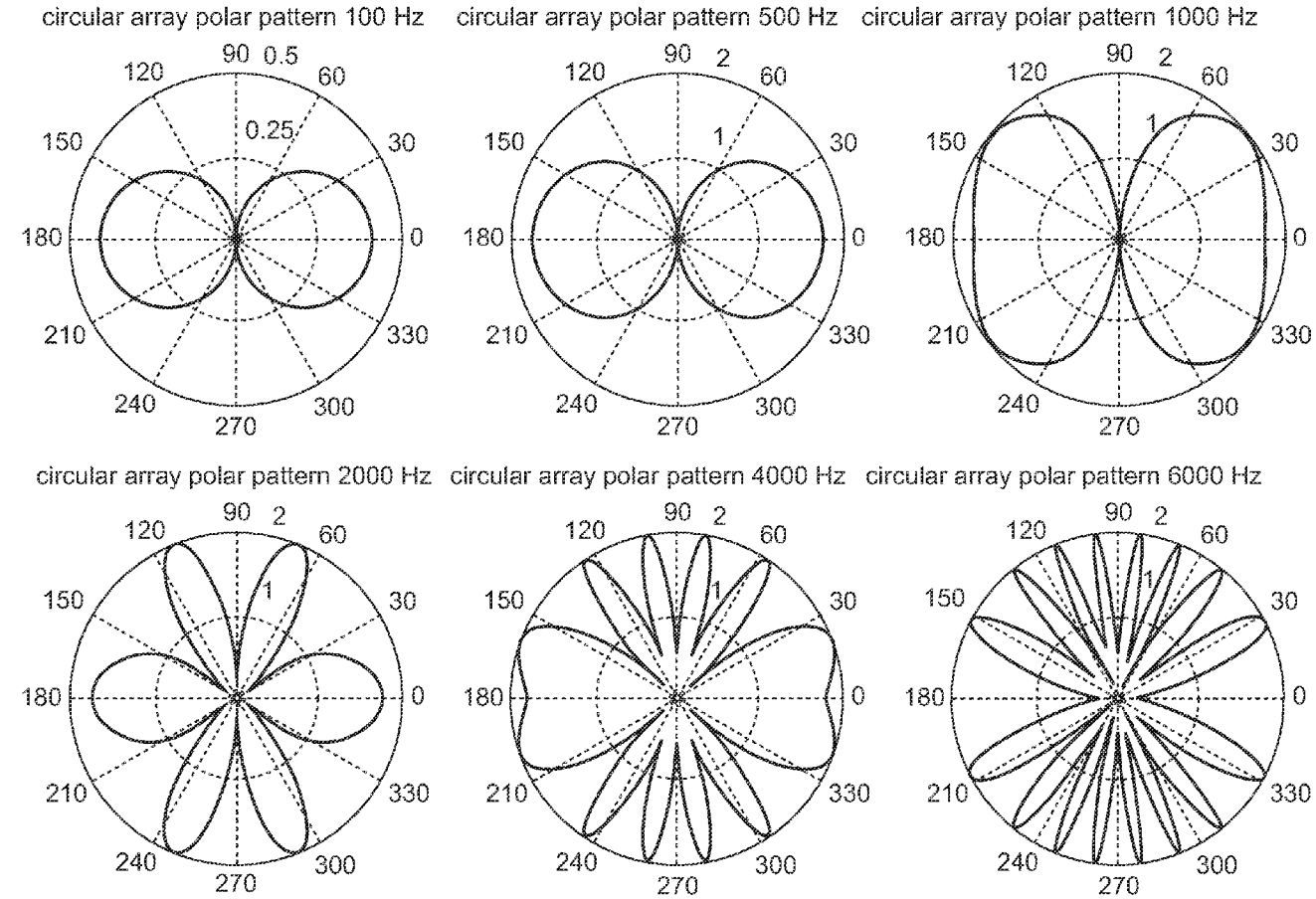

Traditionally the B-format signals are generated by using specially designed (often quite expensive) microphone arrays such as professional soundfield microphones. In this event, the mapping matrix may be designed in advance and keep unchanged in operation. However, in accordance with embodiments of the present invention, the audio signals are captured by an ad hoc network of audio capturing devices which are possibly dynamically grouped with varied topology. As a result, existing solutions may not be applicable to generate W, X, Y channels from such raw audio signals captured by user devices that are not specially designed and positioned. For example, assume that the group contains three audio capturing devices 101 having angles of $\pi/2$, $3\pi/4$, and $3\pi/2$ and same distance to the center at 4 cm. FIGS. 4A-4C show the polar patterns for W, X, and Y channels, respectively, for various frequencies when using the original mapping matrix as described above, respectively. As seen, the outputs of X and Y channels are incorrect since they are no longer orthogonal to each other. In addition, the W channel becomes problematic even as low as 1000 Hz. Therefore, it is desired that the mapping matrix could be adapted flexibly in order to ensure the high quality of the generated surround sound field.

Figure 5A:
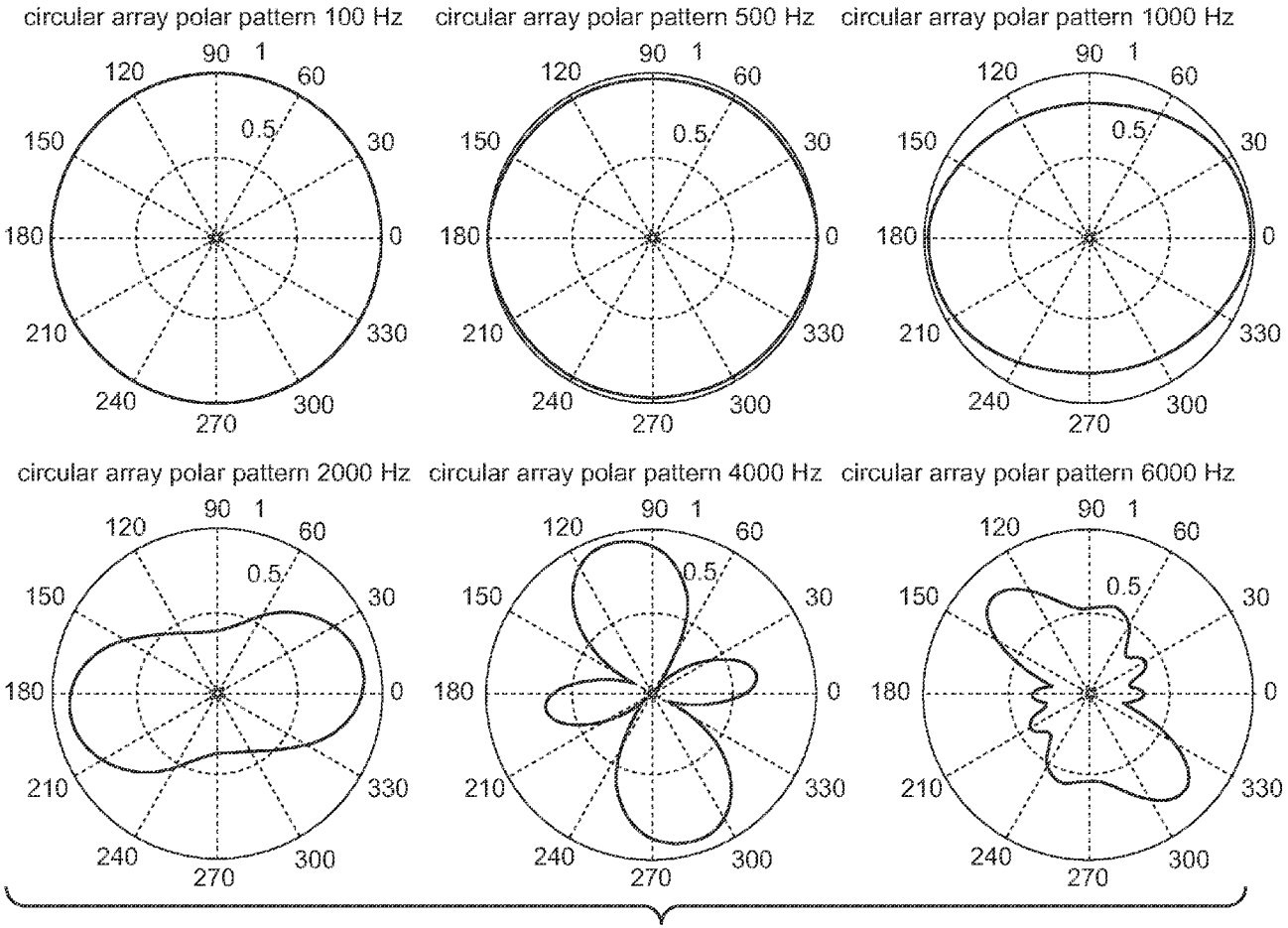
FIGS. 5A-5C show schematic diagrams illustrating polar patterns for W, X, and Y channels, respectively, in B-format processing for various frequencies when using another example mapping matrix.
Figure 5B:
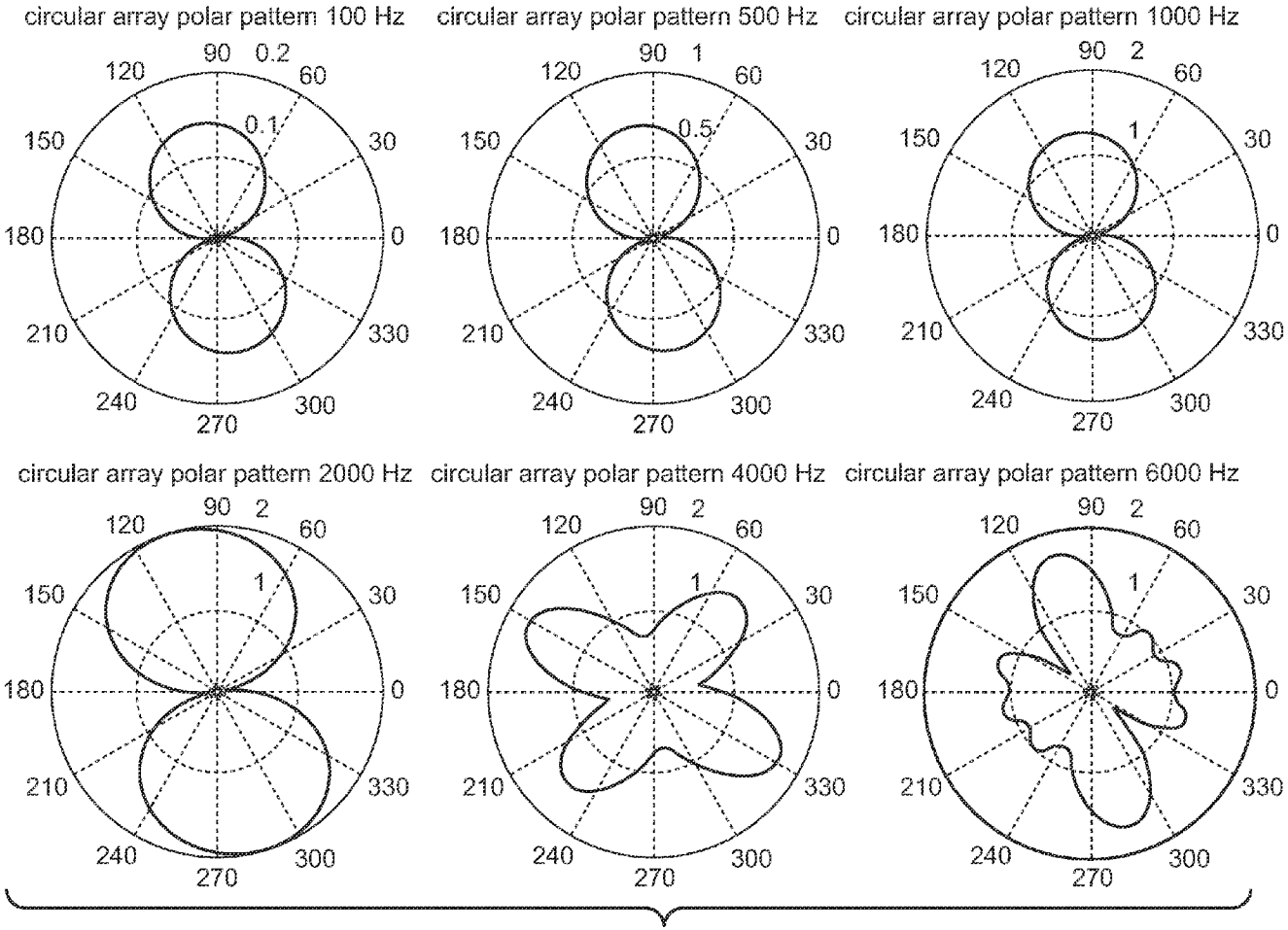
Figure 5C:
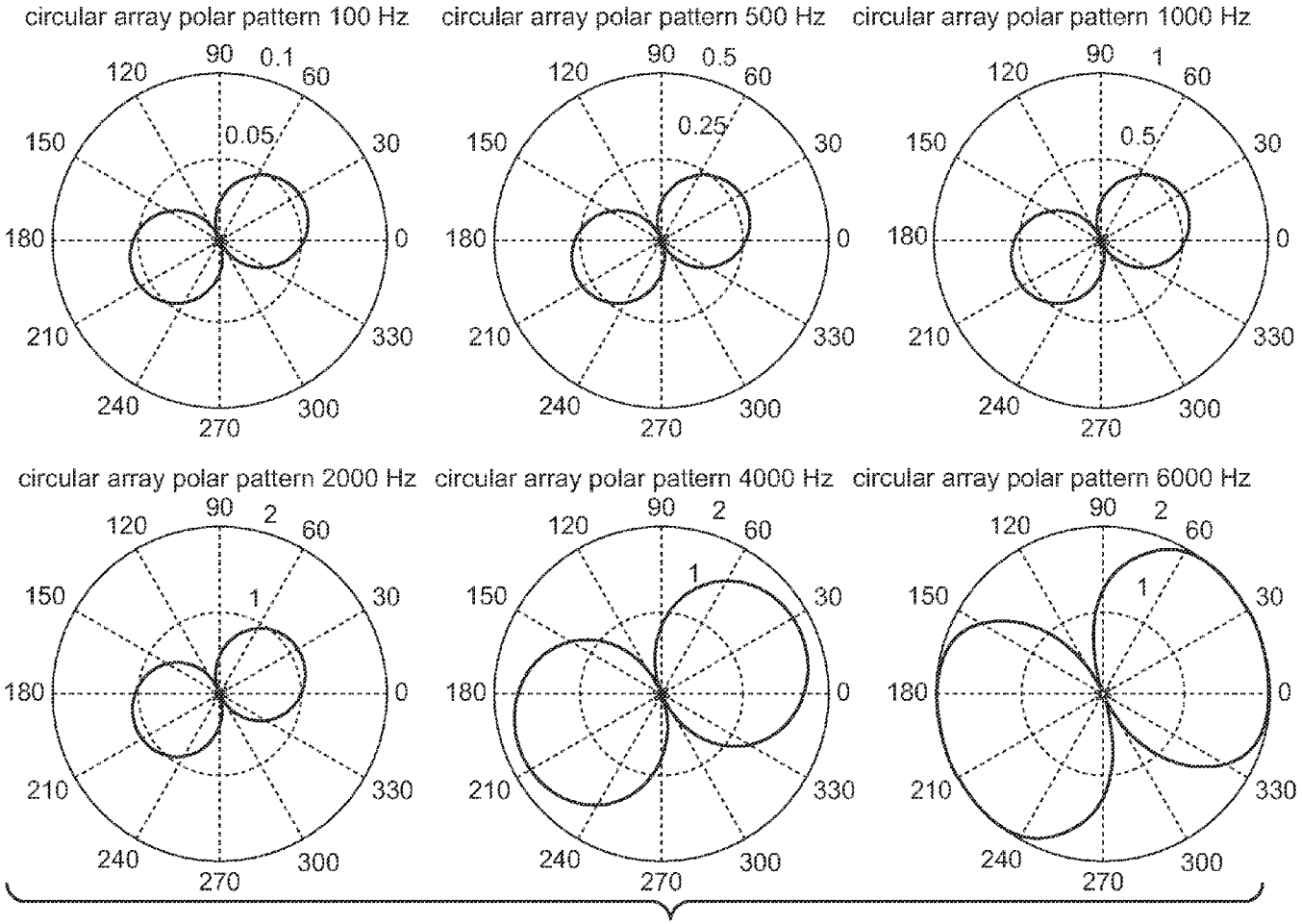

To this end, in accordance with embodiments of the present invention, the weights for respective audio signals, represented as the mapping matrix, may be dynamically adapted based on the topology of audio capturing devices as estimated at step S303. Still considering the above example topology where three audio capturing devices 101 have angles of $\pi/2$, $3\pi/4$, and $3\pi/2$ and same distance to the center at 4 cm, if the mapping matrix is adapted according to this specific topology, for example, as $$W=\begin{bmatrix}\frac{1}{2} & \frac{1}{2} & 0\\ 1 & 0 & -1\\ \frac{6}{7} & -1 & \frac{1}{7}\end{bmatrix},$$

then better results can be achieved, which can be seen from FIGS. 5A-5C that show the polar patterns for W, X, and Y channels, respectively, for various frequencies in this situation.

According to some embodiments, it is possible to select the weights for audio signals based on the estimated topology of the audio capturing devices on-the-fly. Alternatively or additionally, adaptation of the mapping matrix may be realized based on predefined templates. In these embodiments, the server 102 may maintain a repository storing a set of predefined topology templates, each of which is corresponding to a pre-tuned mapping matrix. For example, the topology templates may be represented by the coordinates and/or position relationship of the audio capturing devices. For a given estimated topology, the template that matches the estimated topology may be determined. There are many ways to locate the matched topology template. As an example, in one embodiment, the Euclidean distance between the estimated coordinates of the audio capturing devices and the coordinates in the template are calculated. The topology template with the minimum distance is determined as the matched template. As such, the pre-tuned mapping matrix corresponding to the determined matched topology template is selected for use in the generation of surround sound field in the form of B-format signals.

In some embodiments, in addition to the determined topology template, the weights for audio signals captured by respective devices can be selected further based on a frequency of those audio signals. Specifically, it is observed that for higher frequencies, spatial aliasing start to appear due to relatively large spacing between audio capturing devices. In order to further improve performance, the selection of mapping matrix in B-format processing may be done on the basis of audio frequency. For example, in some embodiments, each topology template may correspond to at least two mapping matrices. Upon determination of the position topology template, the frequency of the received audio signals is compared with a predefined threshold, and one of the mapping matrices corresponding to the determined topology template can be selected and used based on the comparison. Using the selected mapping matrix, the B-format processing is applied to the received audio signals to thereby generate the surround sound field, as discussed above.

It should be noted that although the surround sound field is shown to be generated based on the topology estimation, the scope of the present invention is not limited in this regard. For example, in some alternative embodiments where clock synchronization and distance/topology estimation is not available or already known, the sound field may be generated directly from the cross-correlation process applied to the captured audio signals. For example, in the case that topology of audio capturing devices is known, it is possible to perform the cross-correlation process to achieve some time alignment of the audio signals and then generate the sound field by simply applying a fixed mapping matrix in B-format processing. In this way, the time delay differences for the dominant source among different channels may be essentially removed. As a result, the sensor distance of the array of audio capturing devices may be reduced, thereby creating a coincident array.

Optionally, the method 300 proceeds to step S305 to estimate the direction of arrival (DOA) of the generated surround sound with respect to a rendering device. Then the surround sound field is rotated at step S306 at least partially based on the estimated DOA. Rotating the generated surround sound field according to the DOA is mainly for the purpose of improving the spatial rendering of the surround sound field. When performing B-format based spatial rendering, there is a nominal front, i.e. 0 degree of azimuth, between the left and right audio capturing devices. Sound source from this direction will be perceived as coming from the front during binaural playback. It is desirable to have the target sound source coming from the front, as this is the most natural listening condition. However, due to the very nature of the positioning of audio capturing devices in the ad hoc group, it is impossible to always require the users pointing the left and right devices to the direction of main target sound source, for example, a performance stage. To address this problem, the DOA estimation may be performed using the multi-channel input for rotating the surround sound field according to the estimated angle θ. In this regard, DOA algorithms like Generalized Cross Correlation with Phase Transform (GCC-PHAT), Steered Response Power-Phase Transform (SRP-PHAT), Multiple Signal Classification (MUSIC), or any other suitable DOA estimation algorithms can be used in connection with embodiments of the present invention. Then the sound field rotation can be easily achieved on the B-format signals using standard rotation matrix as follows:

$$\begin{bmatrix} W' \\ X' \\ Y' \end{bmatrix} = \begin{bmatrix} 1 & 0 & 0 \\ 0 & \cos(\theta) & -\sin(\theta) \\ 0 & \sin(\theta) & \cos(\theta) \end{bmatrix} \begin{bmatrix} W \\ X \\ Y \end{bmatrix}$$

In some embodiments, in addition to the DOA, the sound field may be rotated further based on the energy of the generated sound field. In other words, it is possible to find the most dominant sound source both in terms of energy and duration. The goal is to find the best listening angle for a user in a sound field. Let $\theta_n$ and $E_n$ represent the short-term estimated DOA and energy for frame n of the generated sound field, respectively, and the total number of frames is N for the entire generated sound. It is further assumed that the medial plane is 0 degree and the angle is measured counter-clockwise. Then a frame corresponds to a point ($\theta_n$, $E_n$) using polar coordinate representation. In one embodiment, the rotation angle θ' may be determined, for example, by maximizing the following objective function:

$$\theta' = \underset{\theta'}{\operatorname{argmax}} \sum_{n=1}^{N} E_n \cos(\theta_n - \theta')$$

Next, the method 300 proceeds to optional step S307 where the generated sound field may be converted into any target format suitable for playback on a rendering device. Continuing, we consider the examples where the surround sound field is generated as B-format signals. It would be readily appreciated that once a B-format signal is generated, W, X, Y channels may be converted to various formats suitable for spatial rendering. The decoding and reproduction of Ambisonics is dependent on the loudspeaker system used for spatial rendering. In general, the decoding from an Ambisonics signal to a set of loudspeaker signals is based on the assumption that, if the decoded loudspeaker signals are being played back, a "virtual" Ambisonics signal recorded at the geometric center of the loudspeaker array should be identical to the Ambisonics signal used for decoding. This can be expressed as:

$$C \cdot L = B$$

where $L=\{L_1, L_2, \ldots, L_n\}^T$ represents the set of loudspeaker signals, $B=\{W, X, Y, Z\}^T$ represents the "virtual" Ambisonics signal assumed to be identical to the input Ambisonics signal for decoding, and C is known as a "re-encoding" matrix defined by the geometrical definition of the loudspeaker array, i.e. azimuth, elevation of each loudspeaker. For example, give a square loudspeaker array, where loudspeakers are placed horizontally at the azimuth of {45°, −45°, 135°, −135°} and elevation {0°, 0°, 0°, 0°}, this defines C as:

$$C = \begin{bmatrix} 1 & 1 & 1 & 1 \\ \cos(45°) & \cos(-45°) & \cos(135°) & \cos(-135°) \\ \sin(45°) & \sin(-45°) & \sin(135°) & \sin(-135°) \\ 0 & 0 & 0 & 0 \end{bmatrix}$$

Based on this, the loudspeaker signals can be derived as:

$$L = D \cdot B$$

where D represents the decoding matrix typically defined as the pseudo-inverse matrix of C.

In accordance with some embodiments, binaural rendering, in which audio is played back through a pair of earphones or headphones, may be desired since users are expected to listen to the audio files on mobile devices. B-format to binaural conversion can be achieved approximately by summing loudspeaker array feeds that are each filtered by a head-related transfer functions (HRTF) matching the loudspeaker position. In spatial hearing, a directional sound source travels two distinctive propagations paths to arrive at the left and right ear respectively. This results in the arrival-time and intensity difference between the two ear entrance signals, which is then exploited by the human auditory system to achieve localized hearing. These two propagation paths can be well modeled by a pair of direction-dependent acoustic filters, referred as the head-related transfer functions. For example, given a sound source S located at direction ϕ, the ear entrance signals $S_{left}$ and $S_{right}$ can be modeled as:

$$\begin{bmatrix} S_{left} \\ S_{right} \end{bmatrix} = \begin{bmatrix} H_{left,\varphi} \\ H_{right,\varphi} \end{bmatrix} \cdot S^T$$

where $H_{left,\phi}$ and $H_{right,\phi}$ represent the HRTFs of direction ϕ. In practice, the HRTFs of a given direction can be measured by using probe microphones inserted at a subject's (either a person or a dummy head) ears to pick up responses from an impulse, or a known stimulus, placed at the direction.

These HRTF measurements can be used to synthesize virtual ear entrances signals from a monophonic source. By filtering this source with a pair of HRTFs corresponding to a certain direction and presenting the resulting left and right signals to a listener via headphones or earphones, a sound field with a virtual sound source spatialized at the desired direction can be simulated. Using the four-speaker array described above, we can thus convert the W, X, and Y channels to binaural signals as follows:

$$\begin{bmatrix} S_{left} \\ S_{right} \end{bmatrix} = \begin{bmatrix} H_{left,1} & H_{left,2} & H_{left,3} & H_{left,4} \\ H_{right,1} & H_{right,2} & H_{right,3} & H_{right,4} \end{bmatrix} \cdot \begin{bmatrix} L_1 \\ L_2 \\ L_3 \\ L_4 \end{bmatrix},$$

where $H_{left,n}$ represents the transfer function from the nth loudspeaker to the left ear, and $H_{right,n}$ represents the transfer function from the nth loudspeaker to the right ear. This can be extended to more loudspeakers $$\begin{bmatrix} S_{left} \\ S_{right} \end{bmatrix} = \begin{bmatrix} H_{left,1} & H_{left,2} & \dots & H_{left,n} \\ H_{right,1} & H_{right,2} & \dots & H_{right,n} \end{bmatrix} \cdot \begin{bmatrix} L_1 \\ L_2 \\ \dots \\ L_4 \end{bmatrix},$$

where n represents the total number of loudspeakers.

After converting the generated surround sound field into a suitable format of signals, the server 102 may transmit such signals into the rendering device for display. In some embodiments, the rendering device and the audio capturing device may co-locate on a same physical terminal.

The method 300 ends after step S307.

Figure 6:
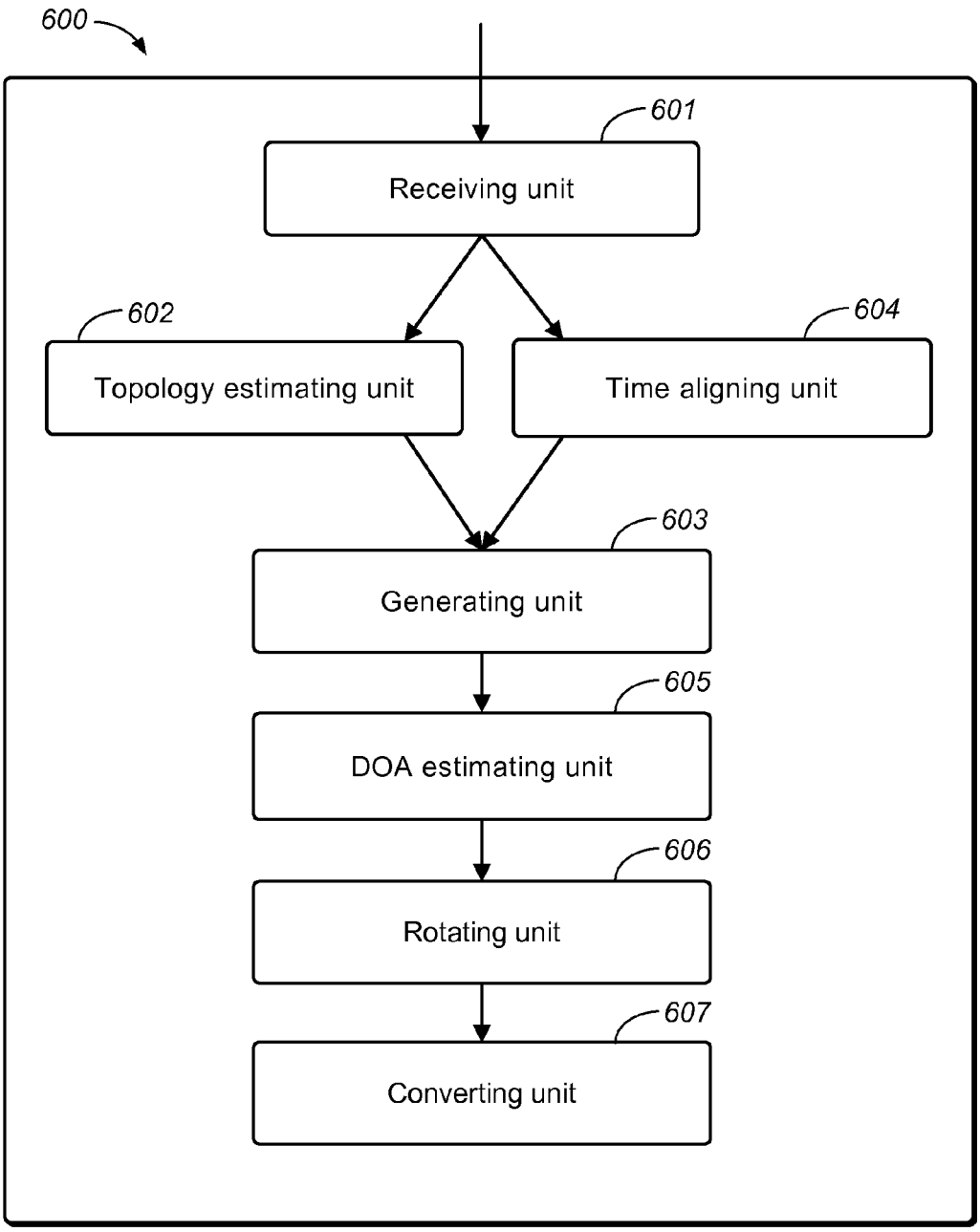
FIG. 6 shows a block diagram illustrating an apparatus for generating a surround sound field in accordance with an example embodiment of the present invention.

Reference is now made to FIG. 6 which shows a block diagram illustrating an apparatus for generating a surround sound field in accordance with an embodiment of the present invention. In accordance with embodiments of the present invention, the apparatus 600 may reside at the server 102 shown in FIG. 1 or is otherwise associated with the server 102, and may be configured to perform the method 300 described above with reference to FIG. 3.

As shown, in accordance with embodiments of the present invention, the apparatus 600 comprises a receiving unit 601 configured to receive audio signals captured by a plurality of audio capturing devices. The apparatus 600 also comprises a topology estimating unit 602 configured to estimate a topology of the plurality of audio capturing devices. Furthermore, the apparatus 600 comprises a generating unit 603 configured to generate the surround sound field from the received audio signals at least partially based on the estimated topology.

In some example embodiments, the estimating unit 602 may comprise a distance acquiring unit configured to acquire a distance between each pair of the plurality of audio capturing devices; and a MDS unit configured to estimate the topology by performing a multidimensional scaling (MDS) analysis on the acquired distances.

In some example embodiments, the generating unit 603 may comprise a mode selecting unit configured to select a mode for processing the audio signals based on a number of the plurality of audio capturing devices. Alternatively or additionally, in some example embodiments, the generating unit 603 may comprise a template determining unit configured to determine a topology template matching the estimated topology of the plurality of audio capturing devices; a weight selecting unit configured to select weights for the audio signals at least partially based on the determined topology template; and a signal processing unit configured to process the audio signals using the selected weights to generate the surround sound field. In some example embodiments, the weight selecting unit may comprise a unit configured to select the weights based on the determined topology template and frequencies of the audio signals.

In some example embodiments, the apparatus 600 may further comprise a time aligning unit 604 configured to perform a time alignment on the audio signals. In some example embodiments, the time aligning unit 604 is configured to apply at least one of a protocol-based clock synchronization process, a peer-to-peer clock synchronization process, and a cross-correlation process.

In some example embodiments, the apparatus 600 may further comprise a DOA estimating unit 605 configured to estimate a direction of arrival (DOA) of the generated surround sound field with respect to a rendering device; and a rotating unit 606 configured to rotate the generated surround sound field at least partially based on the estimated DOA. In some example embodiments, the rotating unit may comprise a unit configured to rotate the generated surround sound field based on the estimated DOA and energy of the generated surround sound field.

In some example embodiments, the apparatus 600 may further comprise a converting unit 607 configured to convert the generated surround sound field into a target format for playback on a rendering device. For example, the B-format signals may be converted into binaural signals or 5.1-channel surround sound signals.

It should be noted that various units in the apparatus 600 correspond to the steps of method 300 described above with reference to FIG. 3, respectively. As a result, all the features described with respect to FIG. 3 are also applicable to the apparatus 600, which will not be detailed here.

Figure 7:
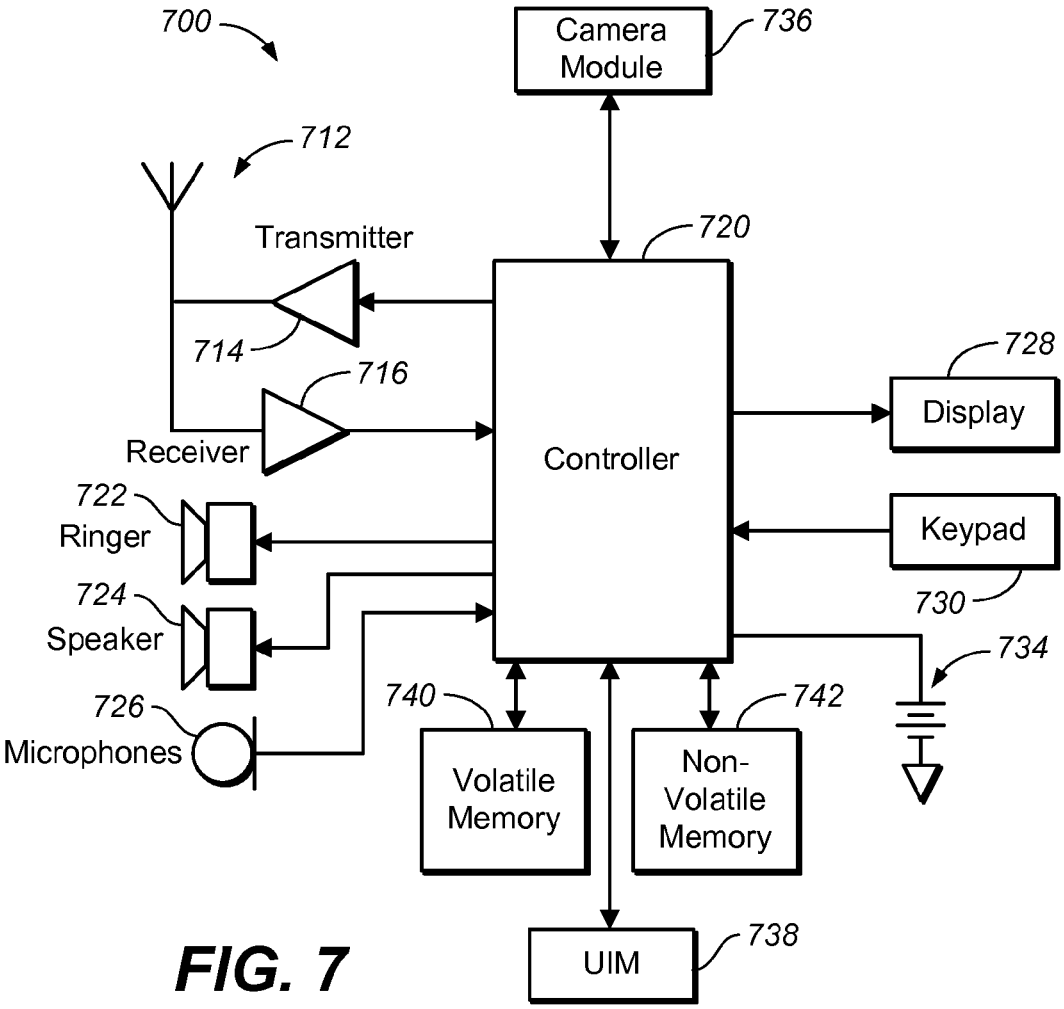
FIG. 7 shows a block diagram illustrating a user terminal for implementing an example embodiment of the present invention.

FIG. 7 is a block diagram illustrating a user terminal 700 for implementing example embodiments of the present invention. The user terminal 700 may operate as the audio capturing device 101 as discussed herein. In some embodiments, the user terminal 700 may be embodied as a mobile phone. It should be understood, however, that a mobile phone is merely illustrative of one type of apparatus that would benefit from embodiments of the present invention and, therefore, should not be taken to limit the scope of embodiments of the present invention.

As shown, the user terminal 700 includes an antenna(s) 712 in operable communication with a transmitter 714 and a receiver 716. The user terminal 700 further includes at least one processor or controller 720. For example, the controller 720 may be comprised of a digital signal processor, a microprocessor, and various analog to digital converters, digital to analog converters, and other support circuits. Control and information processing functions of the user terminal 700 are allocated between these devices according to their respective capabilities. The user terminal 700 also comprises a user interface including output devices such as a ringer 722, an earphone or speaker 724, one or more microphones 726 for audio capturing, a display 728, and user input devices such as a keyboard 730, a joystick or other user input interface, all of which are coupled to the controller 720. The user terminal 700 further includes a battery 734, such as a vibrating battery pack, for powering various circuits that are required to operate the user terminal 700, as well as optionally providing mechanical vibration as a detectable output.

In some embodiments, the user terminal 700 includes a media capturing element, such as a camera, video and/or audio module, in communication with the controller 720. The media capturing element may be any means for capturing an image, video and/or audio for storage, display or transmission. For example, in an example embodiment in which the media capturing element is a camera module 736, the camera module 736 may include a digital camera capable of forming a digital image file from a captured image. When embodied as a mobile terminal, the user terminal 700 may further include a universal identity module (UIM) 738. The UIM 738 is typically a memory device having a processor built in. The UIM 738 may include, for example, a subscriber identity module (SIM), a universal integrated circuit card (UICC), a universal subscriber identity module (USIM), a removable user identity module (R-UIM), etc. The UIM 738 typically stores information elements related to a subscriber.

The user terminal 700 may be equipped with at least one memory. For example, the user terminal 700 may include volatile memory 740, such as volatile Random Access Memory (RAM) including a cache area for the temporary storage of data. The user terminal 700 may also include other non-volatile memory 742, which can be embedded and/or may be removable. The non-volatile memory 742 can additionally or alternatively comprise an EEPROM, flash memory or the like. The memories can store any of a number of pieces of information, program, and data, used by the user terminal 700 to implement the functions of the user terminal 700.

Figure 8:
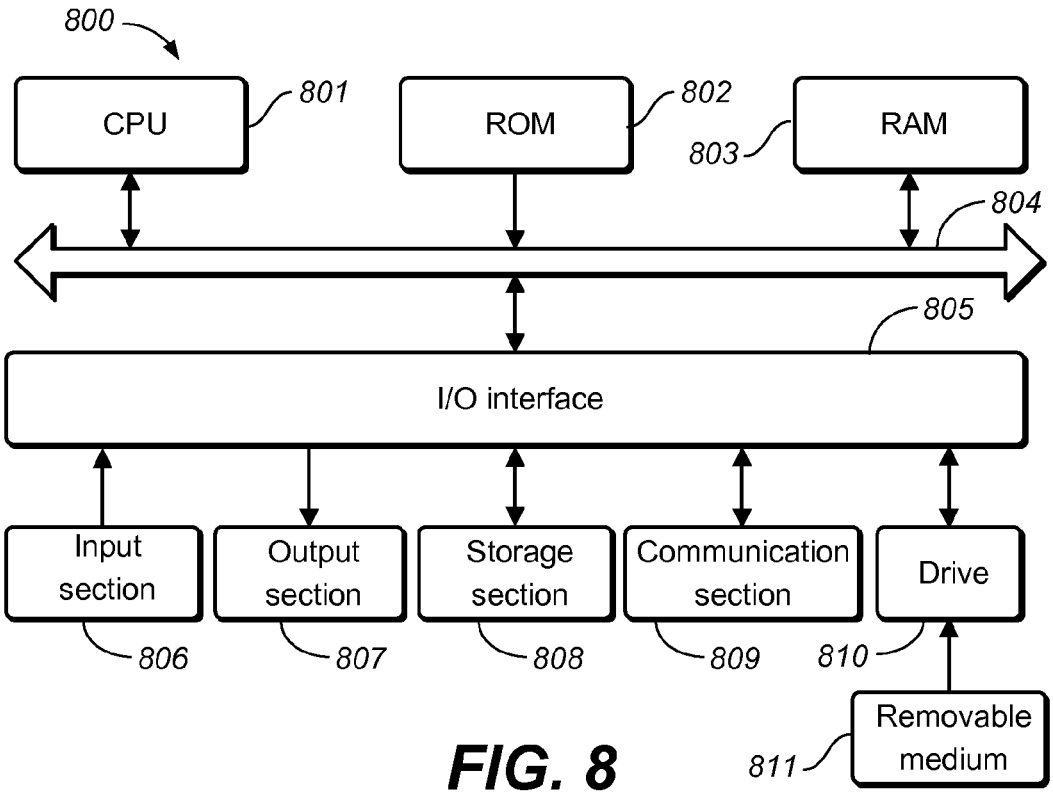
FIG. 8 shows a block diagram illustrating a system for implementing an example embodiment of the present invention.

Referring to FIG. 8, a block diagram illustrating an example computer system 800 for implementing embodiments of the present invention. For example, the computer system 800 may function as the server 102 as described above. As shown, a central processing unit (CPU) 801 performs various processes in accordance with a program stored in a read only memory (ROM) 802 or a program loaded from a storage section 808 to a random access memory (RAM) 803. In the RAM 803, data required when the CPU 801 performs the various processes or the like is also stored as required. The CPU 801, the ROM 802 and the RAM 803 are connected to one another via a bus 804. An input/output (I/O) interface 805 is also connected to the bus 804.

The following components are connected to the I/O interface 805: an input section 806 including a keyboard, a mouse, or the like; an output section 807 including a display such as a cathode ray tube (CRT), a liquid crystal display (LCD), or the like, and a loudspeaker or the like; the storage section 808 including a hard disk or the like; and a communication section 809 including a network interface card such as a LAN card, a modem, or the like. The communication section 809 performs a communication process via the network such as the internet. A drive 810 is also connected to the I/O interface 805 as required. A removable medium 811, such as a magnetic disk, an optical disk, a magneto-optical disk, a semiconductor memory, or the like, is mounted on the drive 810 as required, so that a computer program read therefrom is installed into the storage section 808 as required.

In the case where the above-described steps and processes (for example, method 300) are implemented by the software, the program that constitutes the software is installed from the network such as the internet or the storage medium such as the removable medium 811.

Generally speaking, various example embodiments of the present invention may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments of the present invention are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

For example, the apparatus 600 described above may be implemented as hardware, software/firmware, or any combination thereof. In some embodiments, one or more units in the apparatus 600 may be implemented as software modules. Alternatively or additionally, some or all of the units may be implemented using hardware modules like integrated circuits (ICs), application specific integrated circuits (ASICs), system-on-chip (SOCs), field programmable gate arrays (FPGAs), and the like. The scope of the present invention is not limited in that regard.

Additionally, various blocks shown in FIG. 3 may be viewed as method steps, and/or as operations that result from operation of computer program code, and/or as a plurality of coupled logic circuit elements constructed to carry out the associated function(s). For example, embodiments of the present invention include a computer program product comprising a computer program tangibly embodied on a machine readable medium, the computer program containing program codes configured to carry out the method 300 as detailed above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include but not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments of this invention may become apparent to those skilled in the relevant arts in view of the foregoing description, when read in conjunction with the accompanying drawings. Any and all modifications will still fall within the scope of the non-limiting and example embodiments of this invention. Furthermore, other embodiments of the inventions set forth herein will come to mind to one skilled in the art to which these embodiments of the invention pertain having the benefit of the teachings presented in the foregoing descriptions and the drawings.

Accordingly, the present invention may be embodied in any of the forms described herein. For example, the following enumerated example embodiments (EEEs) describe some structures, features, and functionalities of some aspects of the present invention.

EEE 1. A method of generating a surround sound field, the method comprising: receiving audio signals captured by a plurality of audio capturing devices; performing a time alignment of the received audio signals by applying a cross-correlation process on the received audio signals; and generating the surround sound field from the time aligned audio signals.

EEE 2. The method according to EEE 1, further comprising: receiving information on calibration signals issued by the plurality of audio capturing devices; and reducing a search range of the cross-correlation process based on the received information on the calibration signals.

EEE 3. The method according to any of preceding EEEs, wherein generating the surround sound field comprises: generating the surround sound field based on a predefined topology estimation of the plurality of audio capturing devices.

EEE 4. The method according to any of preceding EEEs, wherein generating the surround sound field comprises: selecting a mode for processing the audio signals based on a number of the plurality of audio capturing devices.

EEE 5. The method according to any of preceding EEEs, further comprising: estimating a direction of arrival (DOA) of the generated surround sound field with respect to a rendering device; and rotating the generated surround sound field at least partially based on the estimated DOA.

EEE 6. The method according to EEE 5, wherein rotating the generated surround sound field comprises: rotating the generated surround sound field based on the estimated DOA and energy of the generated surround sound field.

EEE 7. The method according to any of preceding EEEs, further comprising: converting the generated surround sound field into a target format for playback on a rendering device.

EEE 8. An apparatus of generating a surround sound field, the apparatus comprising: a first receiving unit configured to receive audio signals captured by a plurality of audio capturing devices; a time aligning unit configured to perform a time alignment of the received audio signals by applying a cross-correlation process on the received audio signals; and a generating unit configured to generate the surround sound field from the time aligned audio signals.

EEE 9. The apparatus according to EEE 8, further comprising: a second receiving unit configured to receive information on calibration signals issued by the plurality of audio capturing devices; and reducing unit configured to reduce a search range of the cross-correlation process based on the information on the calibration signals.

EEE 10. The apparatus according to any of EEEs 8 to 9, wherein the generating unit comprises: a unit configured to generate the surround sound field based on a predefined estimation of topology of the plurality of audio capturing devices.

EEE 11. The apparatus according to any of EEEs 8 to 10, wherein the generating unit comprises: a mode selecting unit configured to select a mode for processing the audio signals based on a number of the plurality of audio capturing devices.

EEE 12. The apparatus according to any of EEEs 8 to 11, further comprising: a DOA estimating unit configured to estimate a direction of arrival (DOA) of the generated surround sound field with respect to a rendering device; and a rotating unit configured to rotate the generated surround sound field at least partially based on the estimated DOA.

EEE 13. The apparatus according to EEE 12, wherein the rotating unit comprises: a unit configured to rotate the generated surround sound field based on the estimated DOA and energy of the generated surround sound field.

EEE 14. The apparatus according to any of EEEs 8 to 13, further comprising: a converting unit configured to convert the generated surround sound field into a target format for playback on a rendering device.

It will be appreciated that the embodiments of the invention are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method of generating a surround sound field, the method comprising:

receiving audio signals captured by a plurality of audio capturing devices;

estimating a topology of the plurality of audio capturing devices; and generating the surround sound field from the received audio signals at least partially based on the estimated topology, wherein generating the surround sound field comprises:

applying Ambisonics or B-format processing to the audio signals;

determining a topology template matching the estimated topology of the plurality of audio capturing devices;

selecting weights for the audio signals at least partially based on the determined topology template; and processing the audio signals using the selected weights to generate the surround sound field.

2. The method according to claim 1, wherein selecting the weights comprises:

selecting the weights based on the determined topology template and a frequency of the audio signals.

3. The method according to claim 1, wherein the weights for the audio signals are represented as a mapping matrix for mapping the audio signals to W, X, Y channels of a four channel signal according to the B-format; and selecting the weights for the audio signals comprises selecting a pre-stored mapping matrix corresponding to the topology template matching the estimated topology of the plurality of audio capturing devices.

4. The method according to claim 1 further comprising:

performing a time alignment of the received audio signals.

5. The method according to claim 4, wherein performing the time alignment comprises applying at least one of a protocol-based clock synchronization process, a peer-to-peer clock synchronization process, and a cross-correlation process.

6. The method according to claim 1, further comprising:

converting the generated surround sound field into a target format for playback on a rendering device.

7. An apparatus of generating a surround sound field, the apparatus comprising:

a receiving unit configured to receive audio signals captured by a plurality of audio capturing devices;

a topology estimating unit configured to estimate a topology of the plurality of audio capturing devices; and a generating unit configured to generate the surround sound field from the received audio signals at least partially based on the estimated topology, wherein the generating units configured to apply Ambisonics or B-format processing to the audio signals, and comprises:

a template determining unit configured to determine a topology template matching the estimated topology of the plurality of audio capturing devices;

a weight selecting unit configured to select weights for the audio signals at least partially based on the determined topology template; and a signal processing unit configured to process the audio signals using the selected weights to generate the surround sound field.

8. The apparatus according to claim 7, wherein the weight selecting unit comprises:

a unit configured to select the weights based on the determined topology template and a frequency of the audio signals.

9. The apparatus according to claim 7, wherein the weights for the audio signals are represented as a mapping matrix for mapping the audio signals to W, X, Y channels of a four channel signal according to the B-format; and the weight selecting unit is configured to select a pre-stored mapping matrix corresponding to the topology template matching the estimated topology of the plurality of audio capturing devices.

10. The apparatus according to claim 7, further comprising:

a time aligning unit configured to perform a time alignment of the received audio signals.

11. The apparatus according to claim 10, wherein the time aligning unit is configured to apply at least one of a protocol-based clock synchronization process, a peer-to-peer clock synchronization process, and a cross-correlation process.

12. The apparatus according to claim 9, further comprising:

a converting unit configured to convert the generated surround sound field into a target format for playback on a rendering device.

13. A non-transitory computer-readable medium with instructions stored thereon that when executed by one or more processors configured to carry out the method according to claim 1.

* * * * *